United States Patent [19]

D'Orsay

[11] 4,073,339

[45] Feb. 14, 1978

[54] SWEPT SURFACE HEAT EXCHANGER

[75] Inventor: James Alvin D'Orsay, Georgetown, Maine

[73] Assignee: The De Laval Separator Company, Poughkeepsie, N.Y.

[21] Appl. No.: 747,912

[22] Filed: Dec. 6, 1976

[51] Int. Cl.[2] ..... F28F 7/00

[52] U.S. Cl. ..... 165/94; 62/354; 366/312

[58] Field of Search ..... 34/125, 173, 178, 179; 62/342, 354; 165/94, 87; 259/DIG. 18, 108

[56] References Cited

U.S. PATENT DOCUMENTS

| | | | |
|---|---|---|---|
| 3,206,287 | 9/1965 | Crawford | 165/94 X |
| 3,476,522 | 11/1969 | Stovall | 165/94 X |
| 3,955,617 | 5/1976 | Walsh | 165/94 |

*Primary Examiner*—Ronald H. Lazarus
*Assistant Examiner*—Theophil W. Streule, Jr.
*Attorney, Agent, or Firm*—Cyrus S. Hapgood

[57] ABSTRACT

A stationary cylinder is jacketed to provide a first passage for a first heat exchange medium and forms a chamber for throughflow of a product to be heated or cooled. The cylinder contains a coaxial rotor comprising a shaft having a cylindrical outer surface and forming a second passage for a second heat exchange medium, whereby said stationary cylinder and said shaft surface are heated or cooled by said media. Each of a plurality of tubes has its opposite ends secured to the shaft and has an intermediate portion extending outside the shaft in spaced relation to its cylindrical outer surface. The second heat exchange medium is fed through one end portion of the shaft to adjacent ends of said second passage and said tubes and is discharged from the opposite ends thereof through the other end portion of the shaft. Scraper means protrude from the rotor between adjacent tubes and are operable to sweep the inner surface of the jacketed cylinder.

4 Claims, 2 Drawing Figures

Figure 1:
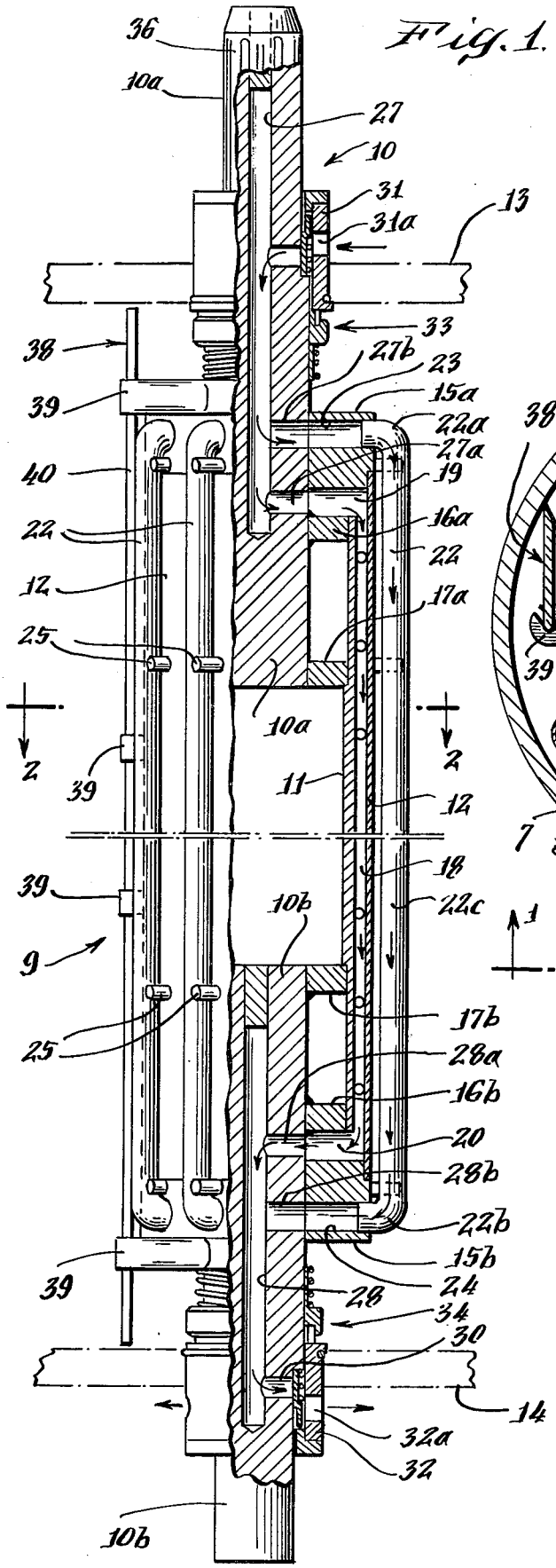

36
10a
27
10
31
31a
13
33
38
27b
23
39
15a
22a
27a
40
19
16a
22
12
17a
25
10a
2
2
39
11
12
18
39
10b
22c
9
17b
25
28a
16b
20
28b
22b
15b
39
24
28
34
30
14
32a
32
10b 7
24
9
25
11
38
1
40
25
39
39
18
38
40
7
12
25
5
1
22
4
6

SWEPT SURFACE HEAT EXCHANGER

This invention relates to heat exchangers of the type having a cylinder jacketed for flow of a heat exchange medium and containing a rotor provided with scraper means which continuously sweep the inner, heat-exchanging surface of the cylinder to free it of any product adhering thereto. More particularly, the invention relates to a heat exchanger of this type in which the rotor is also provided with novel means forming extended heat exchanging surfaces acting on the product.

Swept surface heat exchangers basically are made up of a cylinder with a finished inner surface, a rotor mounted approximately on the cylinder axis, and pins or other means carried by the rotor for mounting scraping blades to continuously scrape layers of heated or cooled liquid from the cylinder wall, the heating or cooling being effected usually by a hot or cold medium in an annulus jacket surrounding the heat exchange cylinder. Such a swept surface heat exchanger is disclosed in U.S. Pat. No. 3,633,664 granted Jan. 11, 1972.

It has been proposed heretofore to form the rotor of such heat exchangers with a passage for a second heat exchange medium to heat or cool the cylindrical outer surface of the rotor. In this way, the product mass passing through the chamber in the jacketed cylinder can be heated or cooled from both the outside and the inside of the mass, simultaneously with the mixing of the mass by the action of the scraper means.

The principal object of the present invention is to provide such a heat exchanger having an improved rotor forming extended heat exchanging surfaces which are more effective than those proposed heretofore.

A heat exchanger made according to the invention comprises concentric cylinders forming a first passage for a first heat exchange medium, the inner cylinder defining a chamber for throughflow of a product to be heated or cooled by said medium. The chamber contains a rotor having a shaft mounted for rotation substantially coaxially of the inner cylinder, the shaft forming a second passage for a second heat exchange medium to heat or cool the cylindrical outer surface of the shaft. Each of a plurality of tubes has its opposite ends secured to the shaft and has its intermediate portion extending outside the shaft in spaced relation to its cylindrical outer surface. One end portion of the shaft has an inlet for conducting the second medium through a channel in the shaft to adjacent ends of both the second passage and the tubes, the opposite ends of which lead through a discharge channel of the shaft to an outlet in the other end portion of the shaft. Scraper means protrude from the rotor between adjacent tubes and are operable to sweep the inner surface of the inner cylinder as the rotor is driven.

With this construction, the intermediate portions of the tubes on the rotor are substantially completely immersed in the product mass flowing through the treatment chamber and are moved by the rotor through the product mass transversely to the direction of its flow. Thus, the tubes serve the dual functions of providing additional heating or cooling of the product and kneading or agitating it during its flow through the chamber.

Figure 2:
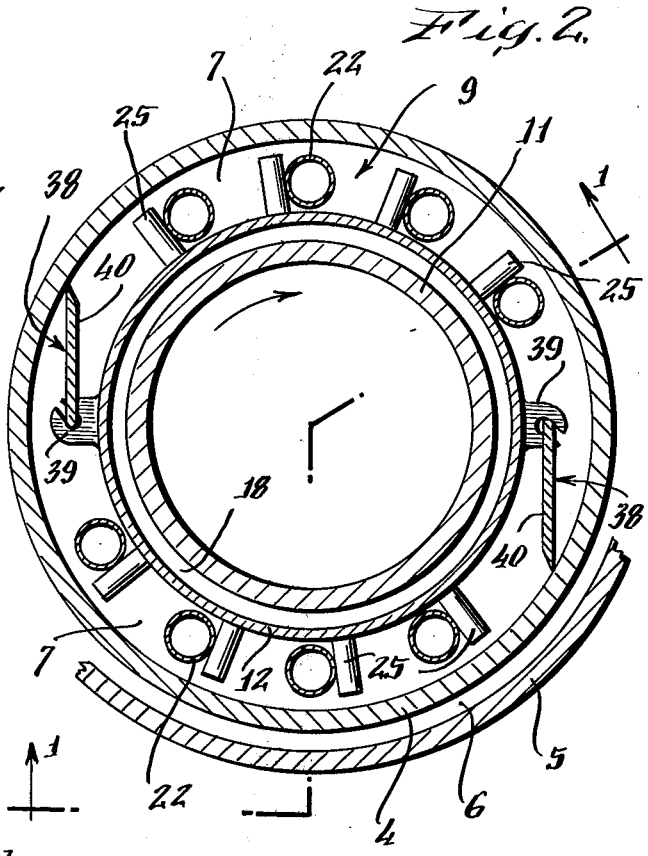

These and other features of the invention will be better understood by reference to the accompanying drawing, in which:

FIG. 1 is a view, partly in elevation and partly in longitudinal section, of a preferred form of the new rotor, the section being taken on line 1—1 in FIG. 2, and FIG. 2 is a sectional view on line 2—2 in FIG. 1, showing also part of the jacketed cylinder containing the rotor.

As illustrated, the heat exchanger comprises stationary concentric vertical cylinders 4 and 5 forming between them an annular first passage 6 for throughflow of a first heat exchange medium (FIG. 2). The manner of mounting these cylinders and the arrangement of the inlet and outlet (not shown) for passage 6 may be as disclosed in said U.S. Pat. No. 3,633,664. The inner cylinder 4 forms a treatment chamber 7 through which the product to be heated or cooled flows generally vertically from an inlet (not shown) at one end to an outlet (not shown) at the other end. Preferably, the product is pumped into the upper part of chamber 7 and discharged from its lower part.

A rotor shown generally at 9 extends vertically through the treatment chamber 7 and includes a shaft 10 mounted for rotation coaxially of the cylinders 4–5. As shown in FIG. 1, the rotor shaft comprises upper and lower portions **10*a* and 10*b* which are interconnected by spaced concentric cylinders 11 and 12. The upper shaft portion 10*a* is journalled in a stationary plate shown in phantom at 13 and releasably connected to inner cylinder 4 to form a closure for the upper end of chamber 7. Similarly, the lower shaft portion 10*b* is journalled in a stationary plate 14 releasably connected to inner cylinder 4 to form a closure for the lower end of chamber 7. If desired, the inlet and outlet for this chamber may be formed in the closure plates 13 and 14**, respectively.

Rings **15*a*, 16*a* and 17*a* are welded or otherwise secured to the upper shaft portion 10*a*, the upper ring 15*a* being of substantially larger diameter than the intermediate and lower rings 16*a*–17*a*. Similar rings 15*b*, 16*b* and 17*b*, respectively, are secured to the lower shaft portion 10*b* but in reverse order, so that the larger-diameter ring 15*b*** is the lower ring.

The inner cylinder 11 of rotor 9 is welded or otherwise secured at its upper and lower end portions to the smaller rings **16*a*–17*a* and 16*b*–17*b*, respectively. Outer cylinder 12 is similarly secured at its upper and lower ends to the larger rings 15*a* and 15*b*, respectively. Thus, the rotor cylinders 11 and 12 form between them an annular vertical passage 18. The upper and lower ends of this passage communicate, respectively, with a space 19 between rings 15*a* and 16*a* and a space 20 between rings 15*b* and 16*b***.

The rotor 9 is provided with a plurality of vertical tubes 22, there being 8 of these tubes as illustrated. Each tube has its upper end **22*a* secured in a bore 23 in ring 15*a* and has its lower end 22*b* secured in a bore 24 in ring 15*b* (FIG. 1). The intermediate portion 22*c* of each tube extends outside the rotor shaft 10*a*–10*b*–11–12 in spaced relation to the outer surface of cylinder 12. The latter has a series of radial detents 25 affixed to the lagging sides of tubes 22, reckoned in the direction of rotation of rotor 9. As illustrated, each tube 22 is affixed to the leading sides of five detents 25** spaced along the tube to reinforce it.

The shaft end portions **10*a* and 10*b* have axial channels 27 and 28 communicating with radial inlets 29 and radial outlets 30, respectively, for a heat exchange medium. This medium is introduced through openings 31*a* in a stationary ring 31 secured in the upper plate 13, and the medium is discharged through openings 32*a* in a stationary ring 32 secured in the lower plate 14. The upper ring 31 surrounds shaft end portion 10*a* in the region of inlets 29 and is sealed to the shaft by sealing means shown generally at 33. Similarly, the lower ring surrounds shaft end portion 10***b* in the region of outlets 30 and is sealed to the shaft by sealing means shown generally at 34. The sealing means 33 and 34 may be of any conventional rotary type.

The upper end of shaft portion 10*a* is splined, as shown at 36, for connection to a drive shaft (not shown).

Diametrically opposed scraper means, shown generally at 38, are secured to the rotor's outer cylinder 12 and protrude between adjacent tubes 22 for scraping the inner surface of stationary cylinder 4. As shown, each scraper means 38 comprises a vertical row of brackets 39 welded to the outer surface of cylinder 12 and to which a scraper blade 40 is releasably secured so that the blade edge is held against the inner surface of cylinder 4. If desired, the scraper means may be constructed as disclosed in said U.S. Pat. No. 3,633,664.

In the operation of the heat exchanger, the product to be heated or cooled is continuously fed into the upper end of annular chamber 7 and discharged from the lower end of this chamber, while rotor 9 is driven in the clockwise direction as viewed in FIG. 2. Simultaneously, a heating or cooling medium is continuously fed generally vertically through the annular chamber 6, in either current or counter-current relation to the product flow. At the same time, a heating or cooling medium is continuously fed from stationary supply ducts (not shown) through the openings 31*a* of stationary ring 31 and thence through the sealing means 33, inlets 29, axial channel 27, and branch channels 27*a* and 27*b* to the upper ends of annular passage 18 and tubes 22 via the annular space 19 and the radial bores 23, respectively. From the lower ends of passage 18 and tubes 22, the heat exchange medium flows via annular space 20 and radial bores 24 through branch channels 28*a* and 28*b*, respectively, and thence through axial channel 28, outlets 30, sealing means 34 and openings 32*a* to stationary discharge ducts (not shown).

Accordingly, as it flows through the treatment chamber 7, the product is heated or cooled by the inner surface of cylinder 4, the outer surface of cylinder 12 and the intermediate portions of the tubes 22 which are immersed in the product. At the same time, rotation of rotor 9 forces the tubes 22 through the interior of the product mass in a direction which is generally transverse to the direction of the product flow. In this way, the tubes provide a highly effective heating or cooling action on the product and also supplement the scraper means 38 in stirring and kneading the product during its flow.

We claim:

1. In a swept surface heat exchanger having a pair of concentric cylinders forming between them a first passage for throughflow of a first heat exchange medium, the inner cylinder defining a treatment chamber for throughflow of a product to be heated or cooled by said medium, a rotor comprising a shaft mounted for rotation in said chamber substantially on the axis of said inner cylinder, the shaft having a cylindrical outer surface and forming a second passage for throughflow of a second heat exchange medium to heat or cool said outer surface, a plurality of tubes each having opposite ends secured to the shaft and each having an intermediate portion extending outside the shaft in spaced relation to said outer surface thereof, one end portion of the shaft having a medium inlet leading via the shaft to adjacent ends of said second passage and said tubes, the other end portion of the shaft having a medium outlet to which adjacent ends of said second passage and said tubes lead via the shaft, scraper means protruding from the rotor between adjacent tubes and operable to sweep the inner surface of said inner cylinder, and stationary means surrounding said first end portion of the shaft in sealed relation thereto for supplying said second medium to said medium inlet.

2. The combination of claim 1, comprising also a plurality of detents radiating from said outer surface of the shaft and engaging said intermediate portions of the respective tubes to resist displacement thereof relative to the shaft.

3. The combination of claim 2, in which the intermediate portions of the tubes are affixed to the respective detents at the leading sides thereof, reckoned in the direction of rotation of the rotor.

4. The combination of claim 1, in which said end portions of the shaft have main channels leading toward each other from said inlet and outlet, respectively, and also have radially extending enlargements connected, respectively, to said opposite ends of the tubes, the shaft including concentric tubular members interconnecting said end portions of the shaft and forming said second passage, each said enlargement having branch channels extending from the corresponding main channel to said second passage and to said tubes.

* * * * *